US006213616B1

(12) United States Patent
Chien

(10) Patent No.: US 6,213,616 B1
(45) **Date of Patent: *Apr. 10, 2001**

(54) CONTAINER WITH ELECTRO-LUMINESCENT LIGHTING

(76) Inventor: Tseng-Lu Chien, 8F, No. 29, Alley 73, Lin-Shen Road, Shi-Chi Town, Taipei, Hseng (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/947,634

(22) Filed: Oct. 9, 1997

(51) Int. Cl.[7] ..... F21V 33/00

(52) U.S. Cl. ..... 362/84; 362/101; 362/154; 362/806

(58) Field of Search ..... 362/101, 84, 154, 362/253, 806; 215/11.1, 228, 230

(56) References Cited

U.S. PATENT DOCUMENTS 4,754,379 * 6/1988 Kelly ..... 362/154
5,245,517 * 9/1993 Fenton ..... 362/156
5,268,827 * 12/1993 Granneman et al. ..... 362/156
5,440,458 * 8/1995 Volk ..... 362/155
5,575,553 * 11/1996 Tipton ..... 362/101
5,599,088 2/1997 Chien .
5,601,358 2/1997 Chien .
5,611,621 3/1997 Chien .
5,615,941 * 4/1997 Scecter ..... 362/154
5,662,408 9/1997 Chien .
5,667,394 9/1997 Chien .
5,667,736 9/1997 Chien .
5,683,164 11/1997 Chien .
5,704,705 1/1998 Chien .
5,785,407 * 7/1998 Ratcliffe et al. ..... 362/101
5,947,584 * 9/1999 Passanante et al. ..... 362/154

* cited by examiner

*Primary Examiner*—Thomas M. Sember
(74) *Attorney, Agent, or Firm*—Howard C. Miskin; Gloria Tsui-Yip

(57) ABSTRACT

A container includes decorations in the form of electro-luminescent elements arranged on or in walls of the container to form designs and messages. Examples of containers to which the decorations may be applied include mugs or cups, baby bottles, arcade-style toy dispensers, gumball or candy dispensers, and vending machines, although the range of containers is virtually unlimited. The inclusion of illumination elements which provide more than background illumination or matrix displays opens up a vast new field of container design possibilities.

3 Claims, 5 Drawing Sheets

CONTAINER WITH ELECTRO-LUMINESCENT LIGHTING

BACKGROUND OF THE INVENTION

1. Field of the Invention

This invention relates to illuminated containers, and in particular to containers illuminated by electro-luminescent lighting elements.

2. Discussion of Related Art

Electro-luminescent elements have been used to decorate and enhance the appearance of objects in a variety of contexts, ranging from shoes, clothing, and backpacks to flying objects, bicycles, signs, audio equipment, night lights, and wristwatches. In the container art, on the other hand, decoration has been limited to static printed or painted designs, and incandescent or LED displays which provide background illumination for the printed or painted designs.

Decorated containers have of course been used since the beginning of mankind, long before the invention of writing, to identify the contents of the container, the manufacturer of the contents, the manufacturer of the container itself, and the owner of the container, as well as to make political, social, and artistic statements. While the styles of decoration has evolved over time, however, the manner of decorating containers has changed little during the last 10,000 years. From the earliest geometric designs, to classical Greek amphorae and Ming Dynasty vases, and the modern coffee mug or Coke bottle, the decoration has always involved either the shape of the container, painting, or printing on the side of the container. Little has done, from the standpoint of technology, to improve upon the ancient decorating techniques.

This situation is no longer adequate. Unlike past times, in which a decorated container stood out, the modern world is saturated with decoration, and a decorated container no longer captures the attention it once did, no matter how artistic or clever the decoration. Supermarkets display thousands of containers, all designed to grab the attention of shoppers, while ordinary household items such as mugs and glasses can be easily manufactured to resemble the greatest artworks of the past. During seasonal events, such as Christmas, decorations are everywhere, all carrying generally the same message and competing for attention.

The present invention offers a way for containers to stand out, by adding electro-luminescent elements to the containers. Electro-luminescent elements differ from other types of lighting elements in that they not only provide light, but because of their paper thin dimensions and wide range of relatively bright colors, can be used to create artistic designs or messages, with low power consumption, rather than simply providing background for other designs.

While it has previously been proposed to add incandescent lighting elements or light emitting diodes (LEDs) to certain containers, such as beer or coffee mugs, such lighting elements are either too fragile or too bulky to be used on a functional or commercially viable container, and therefore have had limited usage. In the case of mugs, for example, the conventional incandescent lights or LEDs must be placed at the base of the mug, altering the basic container design and causing the center of gravity of the container to be higher, thereby affecting the stability of the mug.

The present invention solves these problems in a way which, while based on known technology, represents a quantum leap in the specific area to which the technology is applied, namely containers, adding elements of color and brightness to greatly increase the possibilities for creative design available to the container artisan for the first time since the invention of painting.

SUMMARY OF THE INVENTION

It is accordingly an objective the invention to provide a container having improved visibility, in which the decorations on the container can be readily distinguished, either to enhance the appearance of the container, advertise the contents of the container or another product or service, or provide other messages, without changing the basic design of the container.

It is a further objective of the invention to provide a container in which the decoration includes illuminated elements which, unlike incandescent lights or LEDs, offer increased area for advertisements, artistic designs, or messages, hundreds of color choices, increased brightness, a wide viewing angle, decreased power consumption, and simple installation, and which can be used on any container surface, including curved surfaces, without altering the shape of the container.

It is a still further objective of the invention to provide a container in which the decoration includes illuminated elements that can be placed on either the inside or outside surfaces of the container, within layers of the container structure, or anywhere else on the container.

These objectives are achieved, in accordance with the principles of a preferred embodiment of the invention, by providing a container in which the decoration includes electro-luminescent elements arranged either on an outside surface of the container, between two at least partially transparent layers of the container, or on the inside of an at least partially transparent portion of the container.

In one exemplary implementation of the preferred embodiment of the invention, the container is a beer mug and the electro-luminescent elements are panels or three-dimensional electro-luminescent elements placed on a surface of the mug, or between walls of the mug in the case of a double walled construction such as is conventionally used for thermal or insulated mugs. In other exemplary implementations, the containers include baby bottles, an arcade type toy dispensing apparatus, a gumball or candy dispenser, and a soft drink vending machine.

Power to the electro-luminescent elements is preferably supplied by a power source such as a battery, an inverter, an optional function interface for turning the lighting elements on and off according to a predetermined pattern or timing to achieve such effects as flashing, chasing, random on and off, fade in-out, pair flashing, and the like, and one or more switches responsive to user input or to conditions such as the amount of ambient light.

The containers to which the principles of the invention may be applied include any container designed to hold a material, such liquids, solids, gels, powders, gases, combinations of materials, items, or parts, and even other containers (e.g., vending machines), and which can be made from plastic, glass, paper, tin, cardboard, ceramic, porcelain, or other materials. In addition, the containers to which the principles of the invention may be applied can be selected from the group consisting of bottles, tanks, barrels, boxes, cases, pots, dishes, cartons, glasses, mugs, cups, and buckets, as well as any other types of containers to which decoration can be applied.

DETAILED DESCRIPTION OF THE PREFERRED EMBODIMENTS

Figure 1:
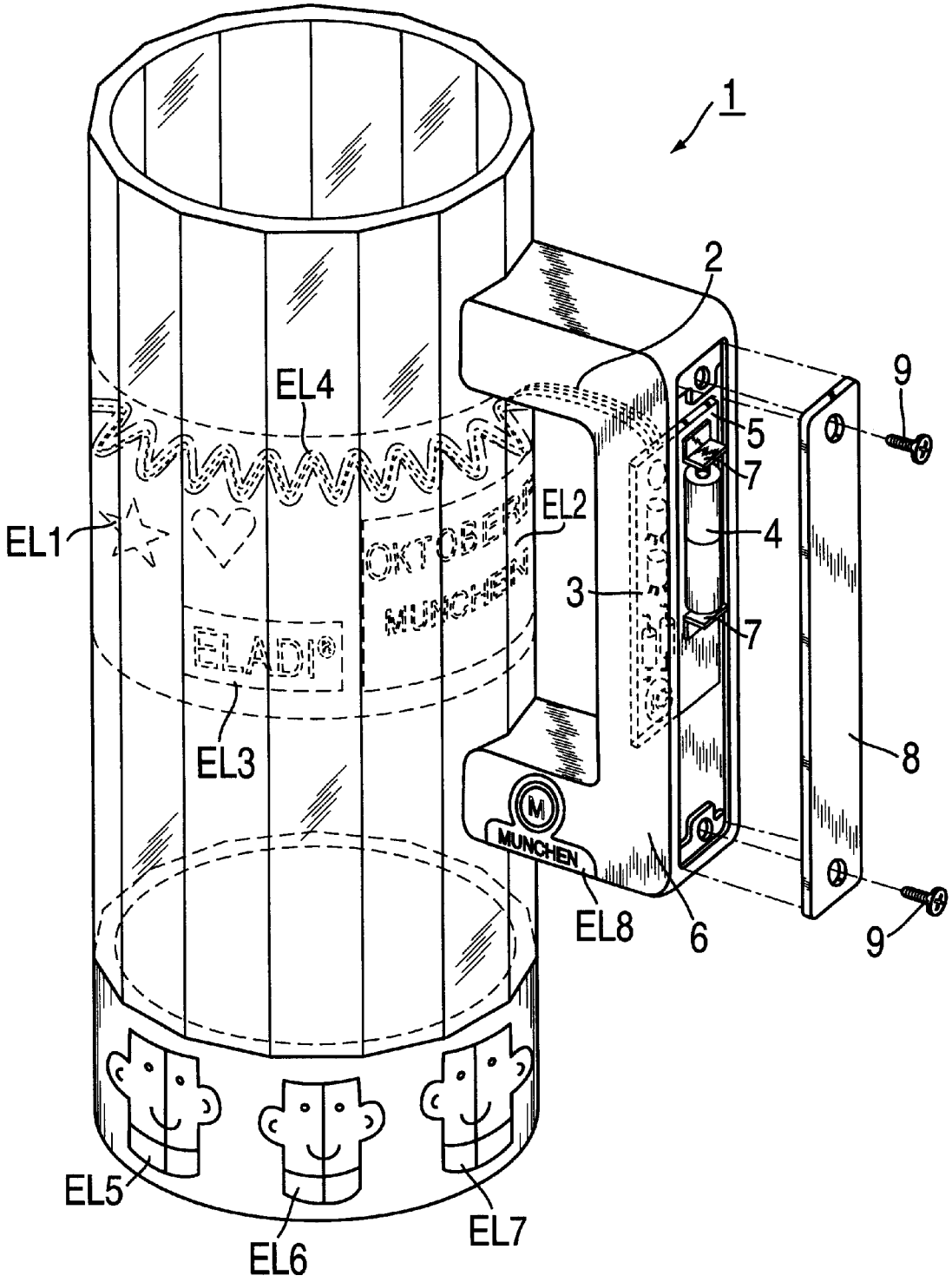
FIG. 1 is a perspective view of a beer mug constructed in accordance with the principles of a preferred embodiment of the invention.
Figure 2:
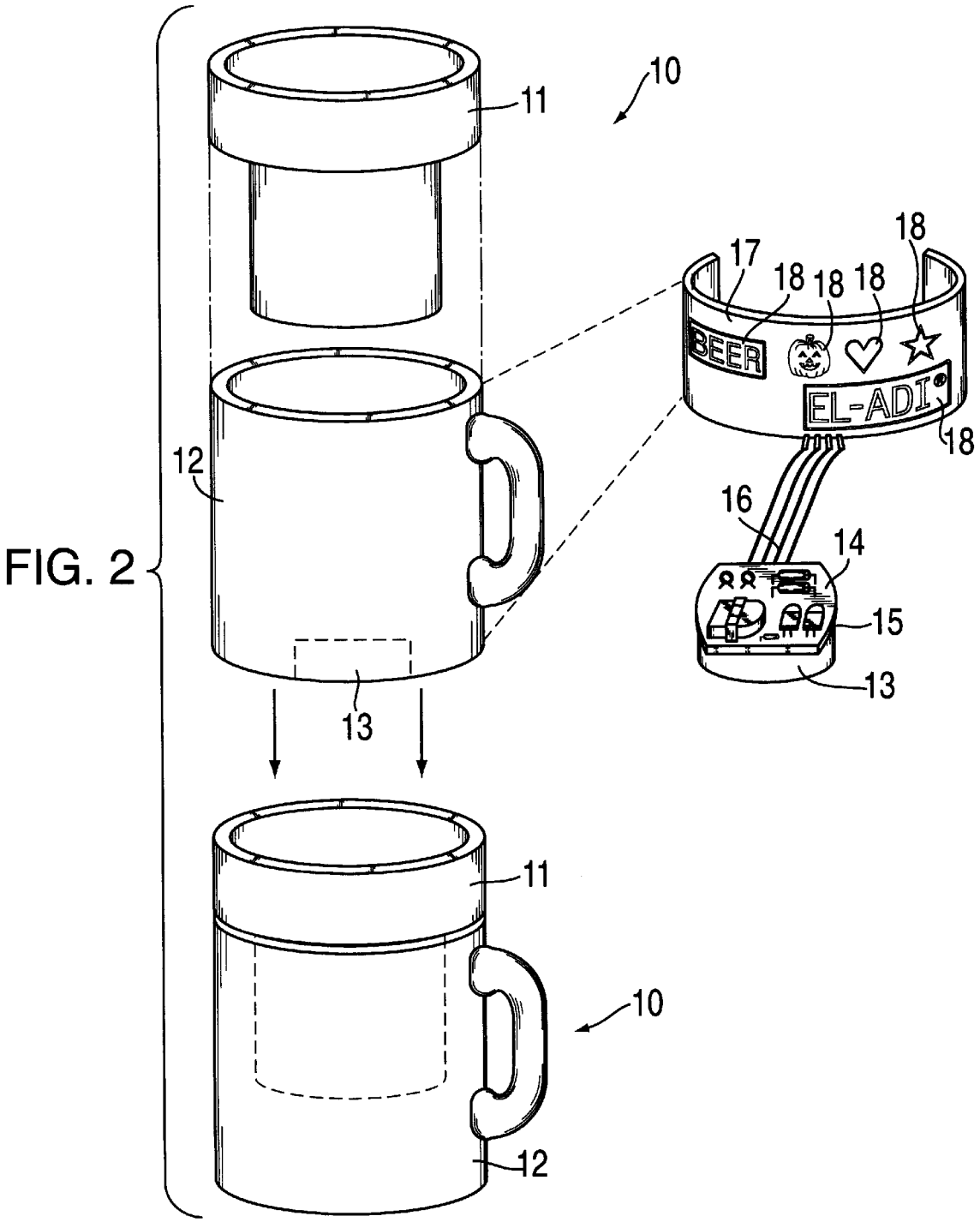
FIG. 2 is a exploded perspective view showing a variation of the mug of FIG. 1.
Figure 3:
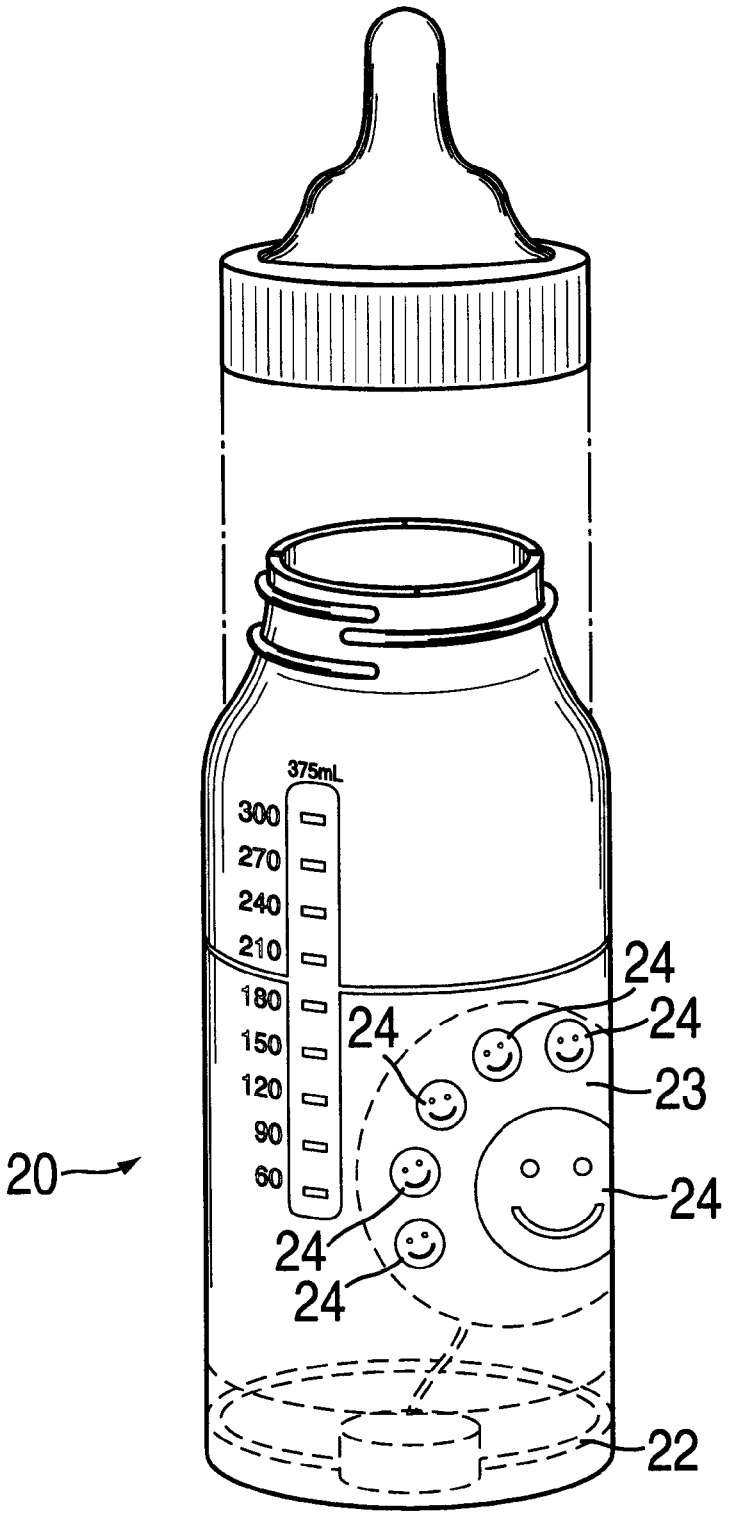
FIG. 3 is a perspective view of a baby bottle constructed in accordance with the principles of the invention.

FIG. 1 illustrates a first type of container 1 constructed in accordance with the principles of the invention to include decorative elements in the form of electro-luminescent lighting elements EL1–EL8. It will be appreciated by those skilled in the art that the term "decorative" refers to any design elements not directly related to the function of the container, and can include purely artistic designs, advertisements, and other messages or symbols identifying the contents of the container, the manufacturer of the container or its contents, or conveying information partially or entirely unrelated to the container or its contents, such as the illustrated "Oktoberfest München" message.

As illustrated in FIG. 1, electro-luminescent elements EL1–EL8 may be placed either on the inside or outside surface of the container 1, and anywhere in or on the base or handle. In the case of a container having a double walled construction, the electro-luminescent elements can also be placed between the walls of the container, so as to be visible through transparent portions of the container, with the space between the walls also providing a convenient place to safely run wires 2 connecting the electro-luminescent elements to a power supply.

The power circuitry 3 is also of known type, and is connected to a power source such as a battery 4 housed in a compartment 5 in the handle 6 of the mug, with standard electrical connections between lighting elements EL1–EL8 and the power source, illustrated as including battery terminals 7 and wires 2. Compartment 4, by way of example, is closed by a cover 8 which affords access to the power source 3 and which may be removably attached by screws 9 or any other suitable means. Descriptions of suitable power circuitry may be found in the above-cited U.S. Patent Applications and other patents and patent applications of the Inventor, though the invention is not to be limited to any particular driver or power circuitry. Advantageously, the circuitry can include a function interface which provides a number of preset or switchable options for turning on the lighting elements, such as steady on, flashing, and sequential or random activation of multiple elements to provide effects such as chasing or pair flashing, and may take any desired form from a simple analog flasher circuit to a microprocessor, depending on the complexity of the special effects to be exhibited. In addition, the circuitry preferably, though not necessarily, will include an inverter circuit, including a transformer or inductor, or other circuitry for controlling the voltage and frequency of power supplied to the electro-luminescent elements in order to optimize the color and brightness of light emitted by the elements.

Each of the decorative elements EL1–EL8 on the illustrated container is in the form of an electro-luminescent element of known type. Examples of EL lighting elements which may be used with the connector arrangement disclosed in the parent application and also disclosed herein are the electro-luminescent panels disclosed in U.S. Pat. No. 5,572,817, and in copending U.S. patent application Ser. Nos. 08/729,408, now U.S. Pat. No. 5,752,337 issued on May 19, 1998 Ser. No. 08/734,872, now U.S. Pat. No. 5,833,508 issued on Nov. 10, 1998 and Ser. No. 08/746,706 now U.S. Pat. No. 5,794,366 issued on Apr. 18, 1998 each of which is incorporated by reference herein, as well as the three-dimensional electro-luminescent tube arrangement disclosed in U.S. patent application Ser. No. 08/758,393, which is also incorporated by reference herein. The connector arrangement disclosed herein may also be used with the optical device disclosed in U.S. patent application Ser. No. 08/841,624 (pending), also incorporated herein by reference, which is a continuation of U.S. patent application Ser. No. 08/489,160 (abandoned).

For example, the electro-luminescent elements EL1–EL8 may be of the type disclosed in U.S. Pat. No. 5,572,817 and copending U.S. patent application Ser. Nos. 08/729,408, 08/734,872, and 08/746,706, in which attractive designs are obtained by including logos, figures, cartoon characters, words, on either the walls of the container or the electro-luminescent element itself, either by printing, silk-screening, stencilling, or the like, and/or by appropriately arranging the phosphor segments of different electro-luminescent panels. Alternatively, or in addition to electro-luminescent panels, the container may include three-dimensional electro-luminescent tubes (not shown) arranged in an attractive pattern in the manner described in copending U.S. patent application Ser. No. 08/758,393.

The effects obtained by the illustrated electro-luminescent elements may be enhanced by including an optical effects device, which may be part of the container itself, similar to the one described in copending U.S. patent application Ser. No. 08/841,624 and its parent U.S. patent application Ser. No. 08/489,160. In the arrangement disclosed in this patent application, the image of an electro-luminescent element is enhanced by passage through a transparent transmission medium such as water, a gel, a solid transparent medium, epoxy, silicone, PVC, PC, acrylic, or the like to increase the apparent brightness of the element. The optical device can be form a convex or concave lens, and can magnify the image, change the image location, change the focus, or change the color of emitted light in a simple and inexpensive yet effective manner. In some cases, the contents of the container itself may be arranged so that light from the electro-luminescent elements is passes through the contents to provide optical effects.

In a variation of the embodiment illustrated in FIG. 1, the container is in the form of a thermal mug or cup 10 having an insulated inner unit 11 for holding a liquid such as coffee, cocoa, or tea, and an outer unit 12 which holds the inner unit and can conveniently also provide space for mounting the power source 13 and related circuitry 14 situated on a circuit board 15 connected by wires 16 to a display panel 17 on which is mounted various electro-luminescent elements 18 in the form, for example, of corporate logos or seasonal designs. Panel 17 can either be mounted on the outer container, be part of or integral with the outer container, or mounted on the inner container or in the space between the inner and outer container so that the electro-luminescent elements are visible through portions of the outer container, which can form a front sheet or panel for the electro-luminescent elements and include windows or designs in the manner described in U.S. Pat. No. 5,572,817 and related patent applications. The area between the inside and outside units can be sealed together or loaded with, for example, artificial snowflakes or thermal material which can be frozen or microwaved to keep liquids in the container cold or hot for extended periods.

In another variation of the preferred embodiment of the invention, the container is in the form of a baby bottle 20 having a power pack 21 in the base and decorations in the form of a three-dimensional electro-luminescent fiber or tube 22 and a multiple segment electro-luminescent panel 23 which includes 6 discrete phosphor elements 24.

Figure 4:
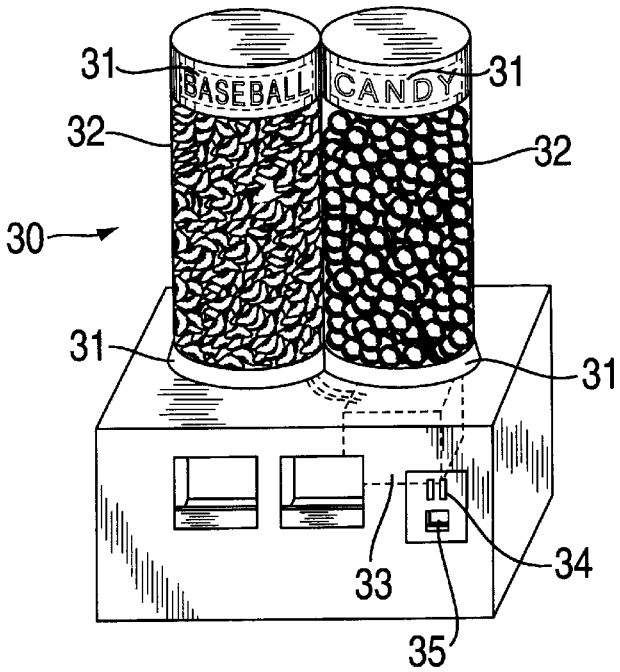
FIG. 4 is a perspective view of a gumball or candy dispenser constructed in accordance with the principles of the invention.

In the embodiment illustrated in FIG. 4, the decorated container is part of a gumball or candy dispenser 30 having electro-luminescent elements 31 situated in or on the walls of respective containers 32, with the power pack 33 being mounted in the main portion of the dispenser containing a coin slot 34 and return 35.

Figure 5:
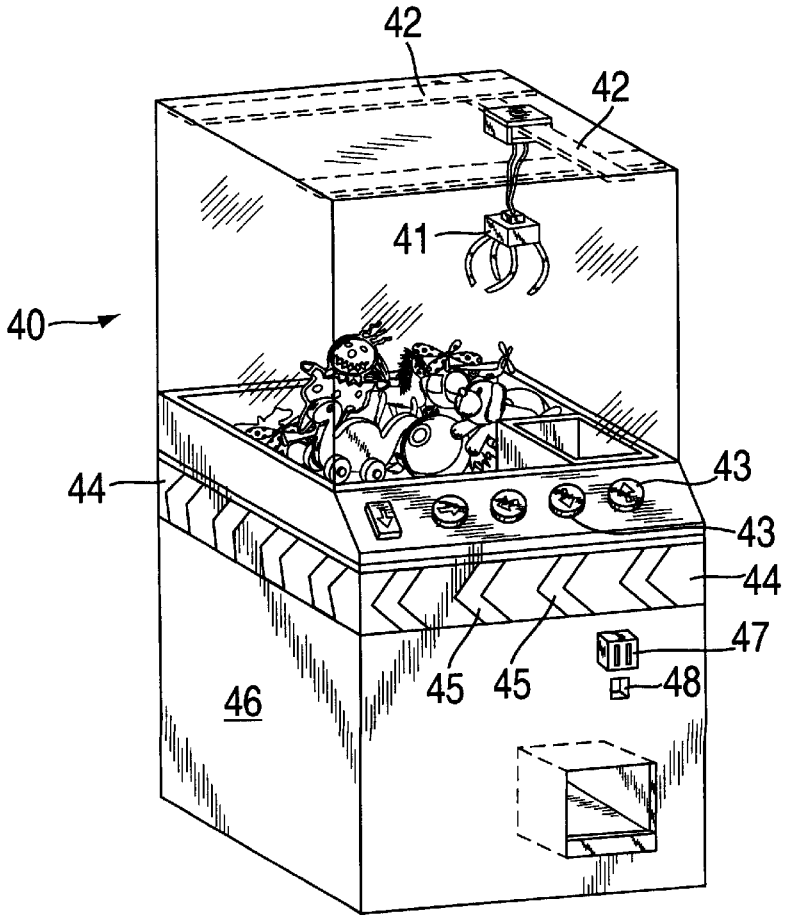
FIG. 5 is a perspective view of an arcade type toy dispenser constructed in accordance with the principles of the invention.

In the embodiment illustrated in FIG. 5, the container is an arcade-style toy dispenser 40 of the type in which toys are dispensed upon manipulation of a moving catcher 41 slidable on rails 42 in response to controls 43, with the decoration being provided by a panel 44 having multiple electro-luminescent segments 45 extending around base portion 46, which contains the mechanism for moving catcher 41, the power pack for the electro-luminescent elements (not shown), a coin slot 47 and a coin return 48.

Figure 6:
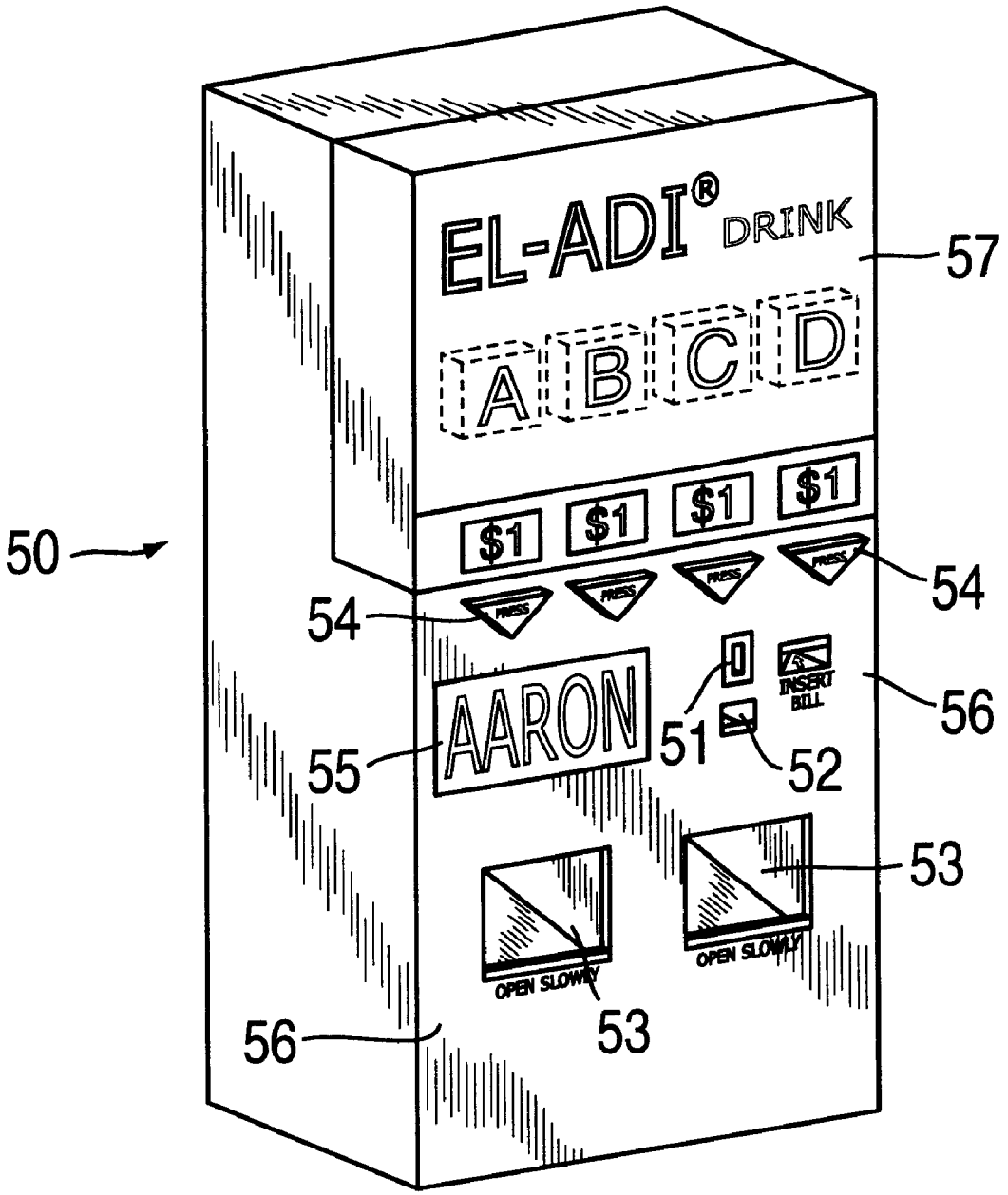
FIG. 6 is a perspective view of a soft drink vending machine constructed in accordance with the principles of the invention.

Finally, in the embodiment illustrated in FIG. 6, the container is a vending machine 50 having a coin input 51, coin return 52, and openings 53 for dispensing items selected by buttons 54. In this embodiment, a multiple segment electro-luminescent panel 55 displaying motion effects is placed on a lower portion of front panel 56 and a further multiple segment electro-luminescent panel 57 identifying contents of the vending machine and its sponsor is placed on the upper portion of the front panel above buttons 54.

Having thus described various preferred embodiments of the invention, those skilled in the art will appreciate that variations and modifications of the preferred embodiment may be made without departing from the scope of the invention. For example, the type of container, the type of electro-luminescent lighting elements, and the power supply and control circuitry therefor are all variable. It is accordingly intended that the invention not be limited by the above description or accompanying drawings, but that it be defined solely in accordance with the appended claims.

I claim:

1. A liquid container, comprising:

a fluid-impermeable containing means for containing a fluid therein:

a power source situated within a handle of the container;

at least one electro-luminescent element arranged to decorate the containing means;

means for supplying power from the power source to the electro-luminescent element, and for controlling the power to achieve a desired illumination effect.

2. A container as claimed in claim 1, wherein the liquid is a beverage.

3. A container as claimed in claim 1, wherein the fluid is a liquid.

* * * * *